US005522592A

United States Patent [19]

Evelsizer, Jr.

[11] Patent Number: 5,522,592

[45] Date of Patent: Jun. 4, 1996

[54] PROTECTIVE DEVICE FOR GOLF CLUBS

[76] Inventor: Rex Evelsizer, Jr., R.D. #2, 51192 Haigh Rd., Oberlin, Ohio 44074

[21] Appl. No.: 334,230

[22] Filed: Nov. 4, 1994

[51] Int. Cl.[6] ..... A63B 57/00

[52] U.S. Cl. ..... 150/160; 206/315.4; 206/315.2; 206/315.6

[58] Field of Search ..... 206/315.2, 315.4, 206/315.6; 150/160, 52 G, 154, 159; 273/162 R, 32 R, 32 B; 248/96

[56] References Cited

U.S. PATENT DOCUMENTS

| | | | |
|---|---|---|---|
| 1,903,798 | 4/1933 | Turner | 229/93 |
| 4,497,404 | 2/1985 | Lowrence | 206/315.2 |
| 5,005,624 | 9/1991 | Sung | 206/315.2 |
| 5,090,583 | 2/1992 | Hoffman et al. | 220/375 |
| 5,150,528 | 9/1992 | Shire | 220/375 |
| 5,200,153 | 4/1993 | Carr et al. | 220/375 |
| 5,207,323 | 5/1993 | McConnell | 150/154 |
| 5,275,278 | 1/1994 | Henry et al. | 206/315.2 |

*Primary Examiner*—Vincent Millin
*Assistant Examiner*—Charles W. Anderson
*Attorney, Agent, or Firm*—Rankin, Hill, Lewis & Clark

[57] ABSTRACT

A protective device for golf clubs includes a pair of relatively non-extensible straps that are attached at one end to a cap and at the other end to the open end of a golf club head cover. When the head cover is placed on the golf club, the cap can be placed on the grip end of the club so as to apply a slight tension to the head cover by way of the straps. Accordingly, the head cover will be maintained in place on the golf club. The device can be provided to consumers for attachment to existing head covers, or it can be provided to consumers as an assembled head cover-straps-cap unit. In alternative embodiments, the straps can be connected releasably to the head cover, and the length of the straps can be adjusted to accommodate clubs or head covers of different lengths.

17 Claims, 2 Drawing Sheets

PROTECTIVE DEVICE FOR GOLF CLUBS

BACKGROUND OF THE INVENTION

1. Field of the Invention

The invention relates to devices for protecting golf clubs and, more particularly, to a technique for protecting the shafts of golf clubs.

2. Description of the Prior Art

Protective devices for golf clubs have been known for many years. These devices usually are in the form of a soft, resilient cover or receptacle, that surrounds the head of the club so as to protect it from damage. In the particular case of wood clubs, a sleeve is attached to the open end of the receptacle in order to extend along the length of the shaft a small distance. Accordingly, the head cover protects not only the head of the club, but also the shaft at that location where the shaft is connected to the head. Sometimes the receptacle and the sleeve are of a unitary construction, such as a knitted sock. In other instances, the head cover and the sleeve are constructed separately and then joined, as by sewing.

Head covers as described above have functioned adequately to protect wood golf clubs. Such clubs conventionally have been fitted with steel shafts. Because steel is a strong, durable material, there has been little or no need to protect the shafts of the golf clubs; the primary function of the head covers is that of protecting the heads of the clubs. However, the advent of shafts made of composite materials such as graphite, boron-graphite, and the like, has presented problems that existing head covers have not dealt with adequately. Composite shafts are sensitive to damage from abrasion or impact. Accordingly, it has become necessary to provide head covers that not only protect the heads of wood clubs, but also surround, and extend along the length of, the shafts in order to provide at least some measure of protection for the shafts.

The principal cause of damage to a composite shaft occurs when the shaft is placed in a golf bag and the golf bag thereafter is transported from place to place. The jostling that naturally occurs during such movement of the golf bag causes the shaft to rub back and forth along the upper edge of the golf bag, thereby causing localized damage to the shaft. While existing head covers having extended-length sleeves theoretically would protect against such damage (by covering the shaft and extending into the golf bag well below the region of contact between the golf bag and the shaft), such head covers have not performed well in practice.

The problem largely arises because the sleeve of a head cover is very flexible and compressible, and is larger in diameter than the shaft. When a number of golf clubs having similarly constructed head covers are placed into a golf bag, the sleeves of one or more of the head covers may not fit readily into the golf bag. Even if the golf bag is large enough to accommodate all of the extended-length sleeves, it frequently happens that a player will not take the time to ensure that the sleeves extend into the golf bag. In other words, if a player quickly places a club into the bag without insuring that the sleeve has been fitted into the bag, the sleeve will be pushed up along the shaft toward the head, thereby exposing the shaft to possible damage.

In view of the foregoing problems associated with protecting golf clubs, it would be desirable to have a device that could protect golf clubs, particularly composite-shafted golf clubs, without any special effort or care being required by the user. Preferably, any such device would be inexpensive, easy to use, and could be adapted for use with golf clubs of any size or length.

SUMMARY OF THE INVENTION

The present invention provides a new and improved device for protecting a golf club having a head, a shaft connected to the head, and a grip end disposed at the opposite end of the shaft from the head. The invention can be applied to existing head covers, or it can be incorporated as part of new head cover construction. In the latter instance, the invention includes a head cover having a receptacle for receiving the head of the golf club and a sleeve connected to the receptacle for extending over the shaft of the golf club adjacent the head toward the grip end. The sleeve includes an open end through which the head and the shaft may be inserted into the head cover.

A pair of straps are connected at one end to the open end of the sleeve. The straps are connected at the other end to a cap. The cap is of a size and shape to fit over the grip end of the golf club. The straps are of such a length that when the head cover is in place on the golf club and the cap is placed on the grip end of the golf club, the straps provide a slight tension on the sleeve so as to maintain it in a fixed position relative to the shaft. Accordingly, regardless of how the shaft is handled, including the manner in which it is placed into a golf bag, the sleeve will be maintained in position along the length of the shaft so as to prevent it from being damaged.

In the preferred embodiment, the straps are formed of a relatively non-extensible material such as cotton webbing. If desired, the straps can be connected to the sleeve by a releasable connection such as snap connectors. It also is possible to provide an adjustable connection between the straps and the cap by including hook and loop fasteners as part of the ends of the straps. The cap includes spaced, slotted portions through which the straps extend. If the adjustable-length option is selected, the hook and loop fasteners can be attached to each other at a desired position to provide any adjustable length for the straps that may be necessary to apply suitable tension to the sleeve.

The device according to the invention is described in more detail in the accompanying specification and claims, and is illustrated in the accompanying drawings.

DESCRIPTION OF THE PREFERRED EMBODIMENT

Figure 1:
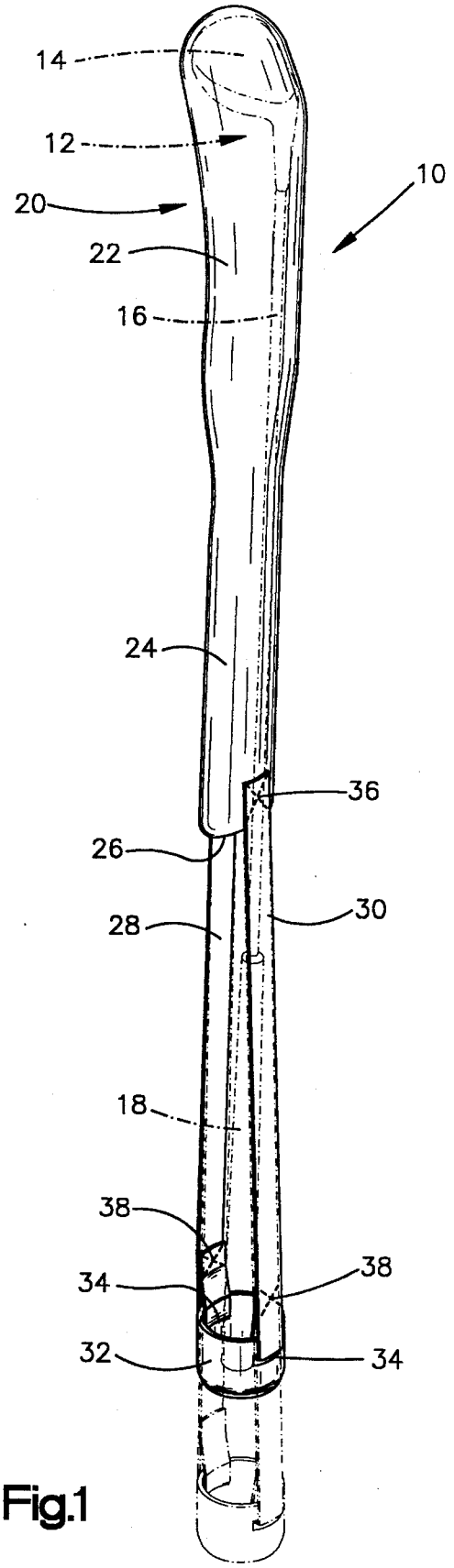
FIG. 1 is a perspective view of a golf club to which a head cover according to the invention has been fitted.
Figure 2:
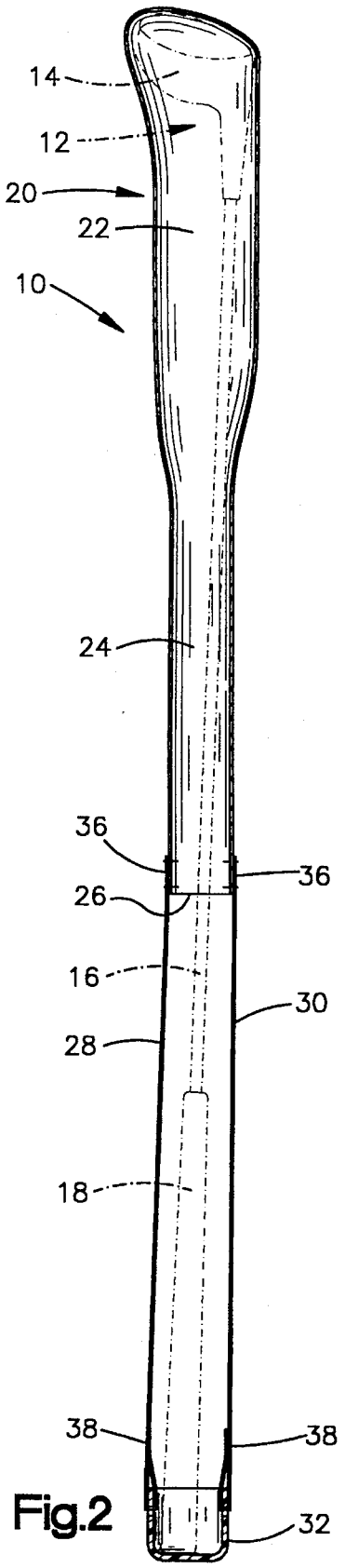
FIG. 2 is a cross-sectional view of the head cover illustrated in FIG. 1.

Referring to FIGS. 1 and 2, a device according to the invention for protecting a golf club is indicated generally by the reference numeral 10. The device 10 is adapted to protect a golf club 12 having a head 14, a shaft 16 connected to the head 14, and a grip end 18 disposed at the opposite end of the shaft 16 from the head 14. The golf club 12 is in the form of a wood club having a shaft 16 formed of a composite material such as graphite or boron-graphite.

A head cover 20 is provided to protect the head 14 and that portion of the shaft 16 adjacent the head 14. The head cover 20 includes a soft, resilient receptacle 22 adapted to fit over the head 14. The head cover 20 also includes a tubular sleeve 24 that is connected to the receptacle 22 and which extends over, and along, the shaft 16 toward the grip end 18. The sleeve 24 includes an open end 26 into which the head 14 can be inserted. As is apparent from an examination of FIGS. 1 and 2, the head cover 20 is attached to the golf club 12 by inserting the head 14 into the sleeve 24 through the open end 26 until the head 14 is fitted completely within the receptacle 22.

The device 10 according to the invention includes first and second elongate straps 28, 30. The straps 28, 30 preferably are formed of a relatively non-extensible material such as cotton webbing, or nylon. The device 10 includes a cap 32 that is of a size and shape such that it will fit over the grip end 18. The cap 32 preferably is formed of a plastics material such as, nylon or polyethylene. Due to its configuration, the cap 32 can be manufactured inexpensively in a molding operation. The cap 32 includes a pair of spaced, slotted portions 34 disposed on opposite sides of the cap 32 closest to the head 14.

As shown in FIGS. 1 and 2, the straps 28, 30 are permanently attached to opposite sides of the open end 26 by means of a sewn connection as indicated at 36. Similarly, the other ends of the straps 28, 30 are passed through the slotted portions 34 and are sewn to each other as indicated at 38.

Figure 3:
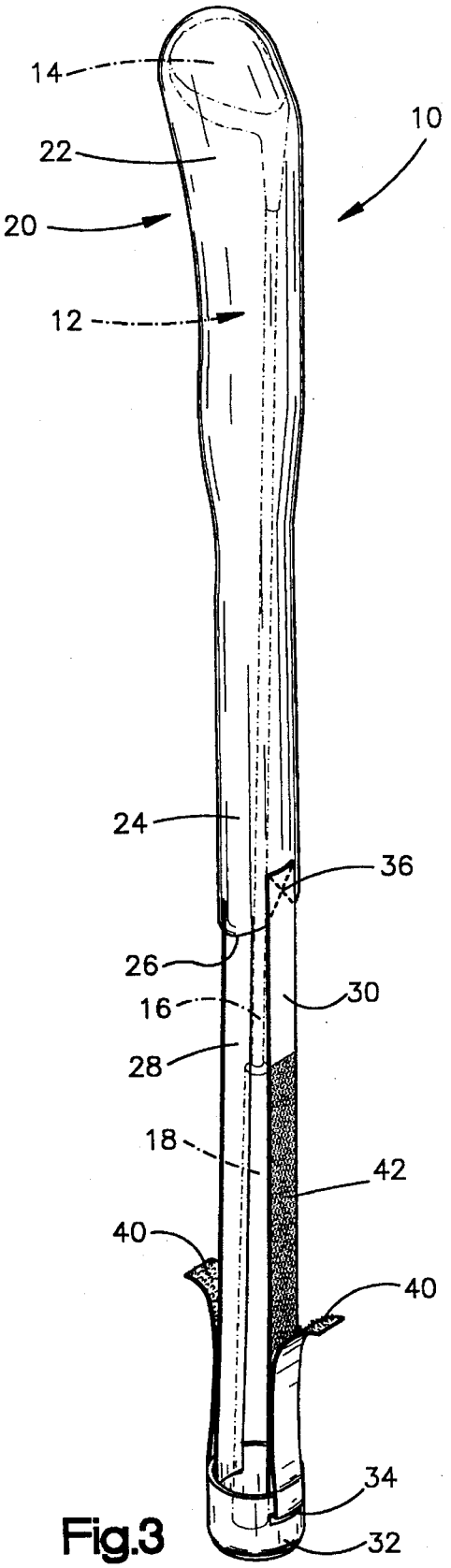
FIG. 3 is a perspective view of an alternative embodiment of the head cover according to the invention showing a releasable, adjustable connection between straps and a cap.

Referring now to FIG. 3, an alternate technique for connecting the straps 28, 30 to the cap 32 is shown. This alternate technique is in the form of hooks 40 and loops 42 that are included as part of the ends of the straps 28, 30 that pass through the slotted portions 34. By employing the hooks 40 and the loops 42 instead of the sewn connection 38, the length of the straps 28, 30 can be adjusted. Such adjustment could be desirable if the device 10 is to be used with clubs or head covers of different lengths.

Figure 4:
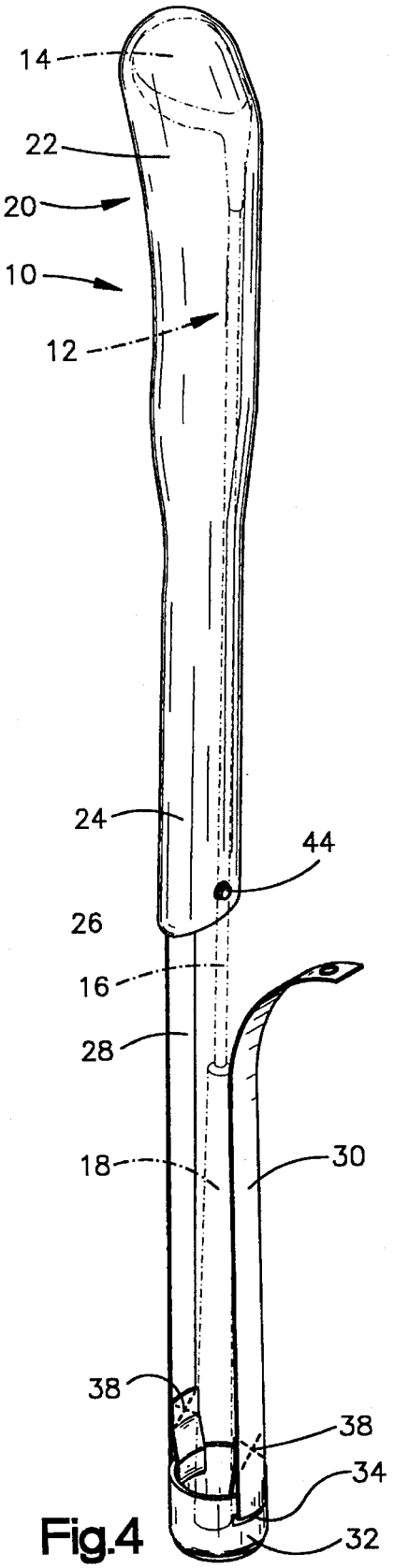
FIG. 4 is a perspective view of an alternative embodiment of the head cover according to the invention showing a releasable between the straps and a sleeve.

Referring now to FIG. 4, an alternate technique for connecting the straps 28, 30 to the sleeve 24 is shown. This alternate technique is in the form of snap connectors 44 that enable the straps 28, 30 to be disconnected from the sleeve 24 whenever desired. It may be desirable at times to disconnect the straps 28, 30 from the head cover 20 for such purposes as cleaning the head cover 20, replacing one of the straps 28, 30, or using the head cover 20 without the straps 28, 30 and the cap 32.

In operation, after attaching the straps 28, 30 to the sleeve 24, the head 14 is inserted through the open end 26 of the sleeve 24 into the receptacle 22. Thereafter; the cap 32 is pulled away from the head 14 so that the cap 32 can be fitted over the grip end 18. Provided that the straps 28, 30 have been provided in the correct length, or have been adjusted to the correct length, the straps 28, 30 will produce a slight tension on the sleeve 24. Because the straps 28, 30 are relatively non-extensible, they will maintain the sleeve 24 in a fixed position relative to the shaft 16. Consequently, the sleeve 24 always will be maintained in that position shown in FIG. 1 so that the shaft 16 will be protected.

As will be apparent from the foregoing description, the device 10 according to the invention is exceedingly inexpensive and easy to manufacture. By using the device 10, the shaft 16 always will be protected, regardless of the manner in which the golf club 12 is handled. A player now can insert the golf club 12 into a golf bag without any concern that the sleeve 24 will not protect the shaft 16.

While the preferred embodiment of the invention has been described and illustrated, it will be appreciated by those skilled in the art that various adaptations and modifications to the invention can be made. It is intended that all such adaptations and modifications that come within the true spirit and scope of the invention will be included as part of the accompanying claims.

What is claimed is:

1. A device for protecting a golf club having a head, a shaft connected to the head, and a grip end at the opposite end of the shaft from the head, comprising:

a head cover, the head cover having a resilient receptacle for receiving the head of the golf club and a sleeve connected to the receptacle for extending over the shaft of the golf club adjacent the head toward the grip end, the sleeve having an open end through which the head and the shaft may be inserted into the head cover;

a pair of straps connected to the open end of the sleeve the straps extending along the length of the shaft;

a cap connected to the straps, the cap being of a size and shape to fit over the grip end of the golf club; and the straps being of a length such that when the head cover is in place on the golf club and the cap is in place on the grip end of the golf club, the straps apply slight tension to the sleeve such that the sleeve is maintained in a fixed position relative to the shaft.

2. The device of claim 1, wherein the straps are formed of a relatively non-extensible material.

3. The device of claim 1, wherein the straps are connected to the sleeve by a releasable connection.

4. The device of claim 3, wherein the releasable connection is in the form of snap connectors.

5. The device of claim 1, wherein the cap is made of a plastics material.

6. The device of claim 1, wherein the straps are connected to the cap by means of a releasable, adjustable connection.

7. The device of claim 6, wherein the cap includes spaced, slotted portions and the straps include hook and loop fasteners at their ends, such that when the ends of the straps are inserted through the slotted portions, the hook and loop fasteners can be attached to each other at a desired position to provide an adjustable length for the straps.

8. A device for attachment to a head cover for a golf club, the golf club having a head, a shaft connected to the head, and a grip end at the opposite end of the shaft from the head, the head cover having a resilient receptacle for receiving the head of the golf club and a sleeve connected to the receptacle for extending over the shaft of the golf club adjacent the head toward the grip end, the sleeve having an open end through which the head and the shaft may be inserted into the head cover, comprising:

a pair of straps connectible to the open end of the sleeve, the straps extending along the length of the shaft;

a cap connected to the straps, the cap being of a size and shape to fit over the grip end of the golf club; and the straps being of a length such that when the head cover is in place on the golf club and the cap is in place on the grip end of the golf club, the straps apply slight tension to the sleeve such that the sleeve is maintained in a fixed position relative to the shaft.

9. The device of claim 8, wherein the straps are formed of a relatively non-extensible material.

10. The device of claim 8, wherein the straps are connected to the sleeve by a releasable connection.

11. The device of claim 10, wherein the releasable connection is in the form of snap connectors.

12. The device of claim 8, wherein the cap is made of a plastics material.

13. The device of claim 8, wherein the straps are connected to the cap by means of a releasable, adjustable connection.

14. The device of claim 13, wherein the cap includes spaced, slotted portions and the straps include hook and loop fasteners at their ends, such that when the ends of the straps are inserted through the slotted portion, the hook and loop fasteners can be attached to each other at a desired position to provide an adjustable length for the straps.

15. A device for protecting a golf club having a head, a shaft connected to the head, and a grip end at the opposite end of the shaft from the head, comprising:

a head cover, the head cover having a resilient receptacle for receiving the head of the golf club and a sleeve connected to the receptacle for extending over the shaft of the golf club adjacent the head toward the grip end, the sleeve having an open end through which the head and the shaft may be inserted into the head cover;

a pair of relatively non-extensible straps connected to opposite sides of the open end of the sleeve, the straps extending along the length of the shaft;

a cap made of a plastics material connected to the straps, the cap being of a size and shape to fit over the grip end of the golf club; and the straps being of a length such that when the head cover is in place on the golf club and the cap is in place on the grip end of the golf club, the straps apply slight tension to the sleeve such that the sleeve is maintained in a fixed position relative to the shaft.

16. The device of claim 15, wherein the straps are connected releasably to the sleeve by snap connectors.

17. The device of claim 15, wherein the straps are connected to the cap by means of a releasable, adjustable connection in the form of spaced, slotted portions included as part of the cap and the straps include hook and loop fasteners at their ends, such that when the ends of the straps are inserted through the slotted portions, the hook and loop fasteners can be attached to each other at a desired position to provide an adjustable length for the straps.

* * * * *